US005980353A

United States Patent [19]

Wu

[11] Patent Number: 5,980,353

[45] Date of Patent: Nov. 9, 1999

[54] CONNECTING DEVICE FOR CONNECTING A FAN BLADE TO A ROTOR OF A MOTOR IF A CEILING FAN

[76] Inventor: San-Chi Wu, No. 69, Sung-Chu Rd. Pei-Tun Dist., Taichung City, Taiwan

[21] Appl. No.: 09/204,115

[22] Filed: Dec. 2, 1998

[51] Int. Cl.[6] ..... B63H 1/20

[52] U.S. Cl. ..... 446/210 R; 416/5; 416/204 R; 416/205; 416/206; 416/207; 416/214 R; 416/220 A; 416/221; 403/294; 403/329; 403/357; 403/367; 403/376

[58] Field of Search ..... 416/5, 204 R, 416/205, 206, 207, 210 R, 214 R, 220 A, 221; 403/294, 329, 357, 367, 376

[56] References Cited

U.S. PATENT DOCUMENTS

| | | | |
|---|---|---|---|
| 3,963,373 | 6/1976 | Macauley | 416/214 A |
| 4,396,352 | 8/1983 | Pearce | 416/206 |
| 5,108,260 | 4/1992 | Monrose III, et al. | 416/142 |
| 5,180,284 | 1/1993 | Monrose III, et al. | 416/204 R |

*Primary Examiner*—Christopher Verdier
*Assistant Examiner*—Matthew T. Shanley
*Attorney, Agent, or Firm*—Ladas & Parry

[57] ABSTRACT

The connecting device includes rotor and blade mounting segments each secured on a rotor and a fan blade at a respective connecting end thereof. A socket end of the rotor mounting segment extends in a radial direction relative to the rotor, and has an insert wall with an insert opening, an insert slot confined by upper and lower inner walls and extending in the radial direction from the insert opening, and an upper outer wall opposite to the upper inner wall. The upper outer wall has a recess communicated with the insert slot to form a retaining wall. A plug end of the blade mounting segment has a bottom wall to be fitted into the insert slot from the insert opening. A resilient retainer has a proximate end secured on the bottom wall, and a distal end with an engaging spring protrusion to provide a biasing force away from the bottom wall. The distal end can be brought to insert into the insert slot and to be kept in sliding contact with the upper inner wall against the biasing force until the engaging spring protrusion abuts against and is retained at the retaining wall of the socket end.

6 Claims, 4 Drawing Sheets

CONNECTING DEVICE FOR CONNECTING A FAN BLADE TO A ROTOR OF A MOTOR IF A CEILING FAN

BACKGROUND OF THE INVENTION

1. Field of the Invention

This invention relates to a connecting device, more particularly to a connecting device for connecting a fan blade to a rotor of a motor of a ceiling fan.

2. Description of the Related Art

Referring to FIG. 1, a conventional ceiling fan is shown to include an outer casing 11 for housing a motor 10, a plurality of fan blades 30 (only one is shown), and a plurality of mounting arms 20 for connecting the fan blades 30 on a bottom of the motor 10, respectively. Each mounting arm 20 has two ends which are respectively secured on the corresponding fan blade 30 and the bottom of the motor 10 by screw fasteners 31,21. However, it is inconvenient to assemble the mounting arms 20 due to the use of the screw fasteners 31,21. Moreover, insufficient tightening of the screw fasteners 31,21 can result in vibration of the mounting arms 20 and in eventual removal of the fan blades 30 from the motor 10 when the ceiling fan operates.

SUMMARY OF THE INVENTION

The object of the present invention is to provide a connecting device which can interconnect conveniently and steadily the fan blade and the rotor of the motor of the ceiling fan.

According to this invention, a connecting device includes a rotor mounting segment secured on a rotor at a rotor connecting end thereof, and a blade mounting segment secured on a fan blade at a blade connecting end thereof. A socket end of the rotor mounting segment extends in a radial direction relative to the rotor, and has an insert wall with an insert opening passing therethrough, an insert slot which is confined by upper and lower inner walls and which extends in the radial direction from the insert opening toward the rotor connecting end, and an upper outer wall opposite to the upper inner wall. The upper outer wall is formed with a recess which extends in the axial direction to be communicated with the insert slot to form a retaining wall that extends transverse to the radial direction. A plug end of the blade mounting segment extends from the blade connecting end in the radial direction, and has a bottom wall to be fitted into the insert slot from the insert opening. A resilient retainer has a proximate end secured on the bottom wall, and a distal end with an engaging spring protrusion to provide a biasing force in the axial direction away from the bottom wall. The distal end can be brought to insert into the insert slot and to be kept in a sliding contact with the upper inner wall against the biasing force of the protrusion until the engaging spring protrusion abuts against and is retained at the retaining wall of the socket end.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
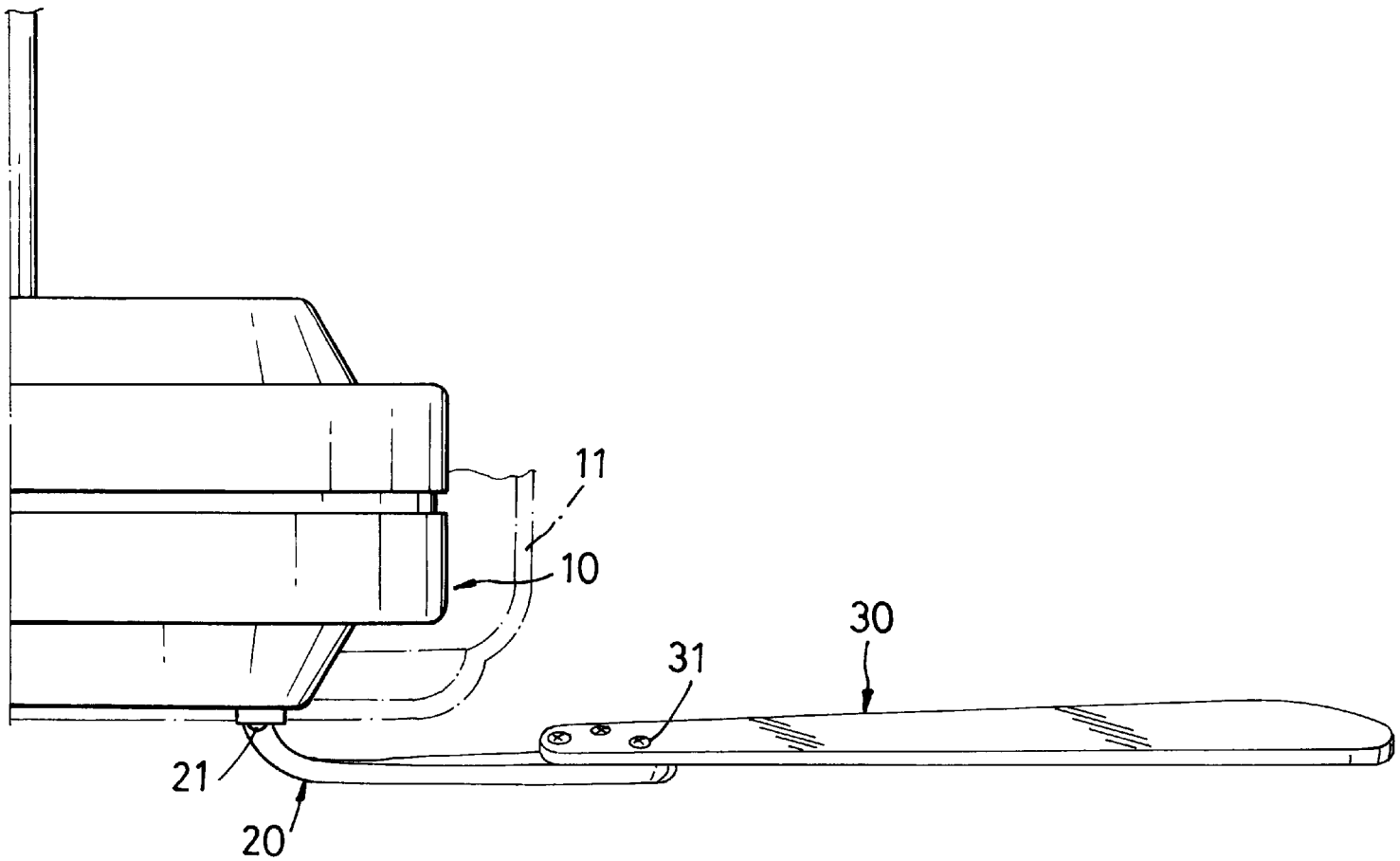
FIG.1 PRIOR ART
FIG. 1 is a schematic view of a conventional connecting device for connecting a fan blade to a motor of a ceiling fan.
Figure 2:
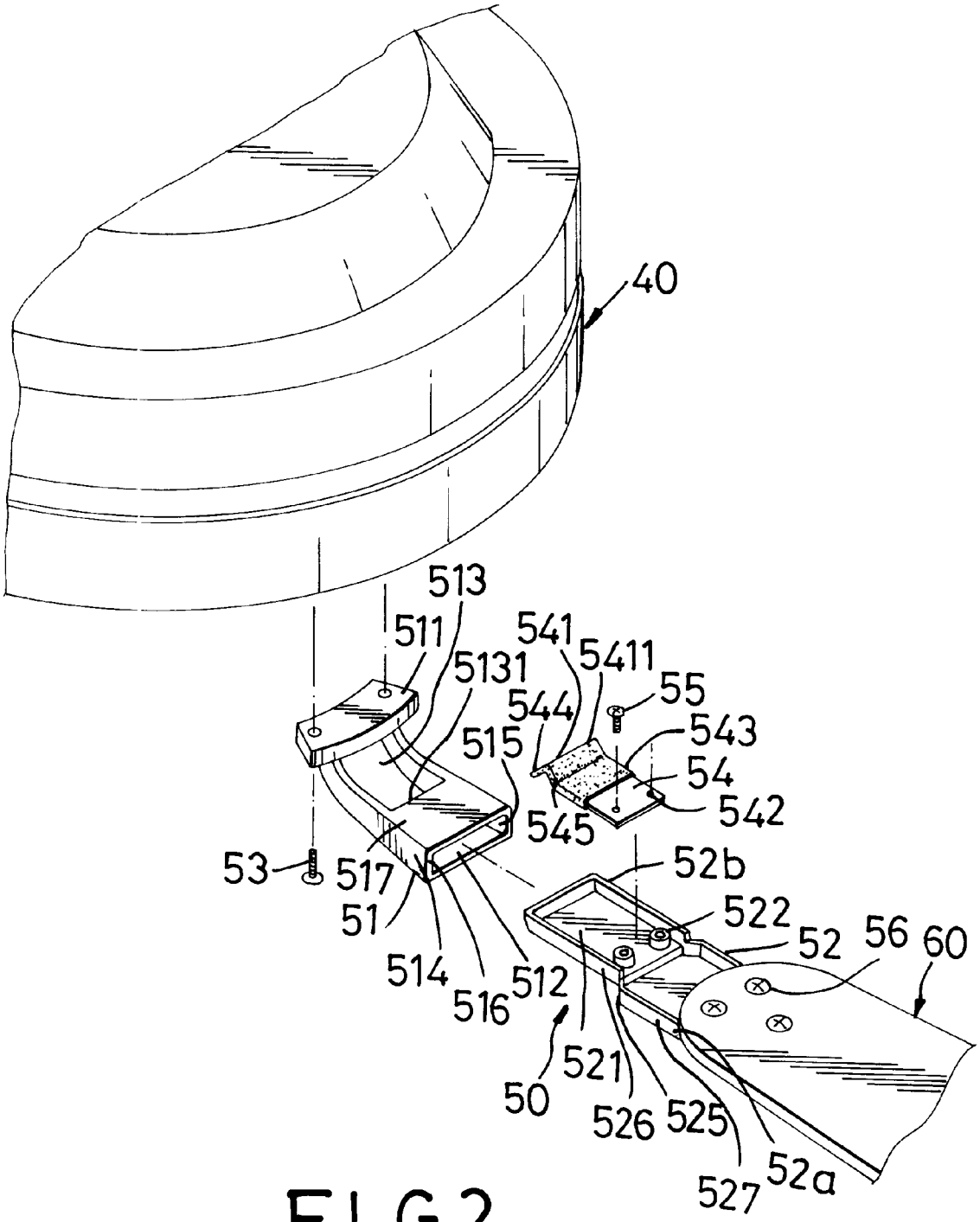
FIG. 2 is an exploded view of a preferred embodiment of a connecting device according to this invention.
Figure 4:
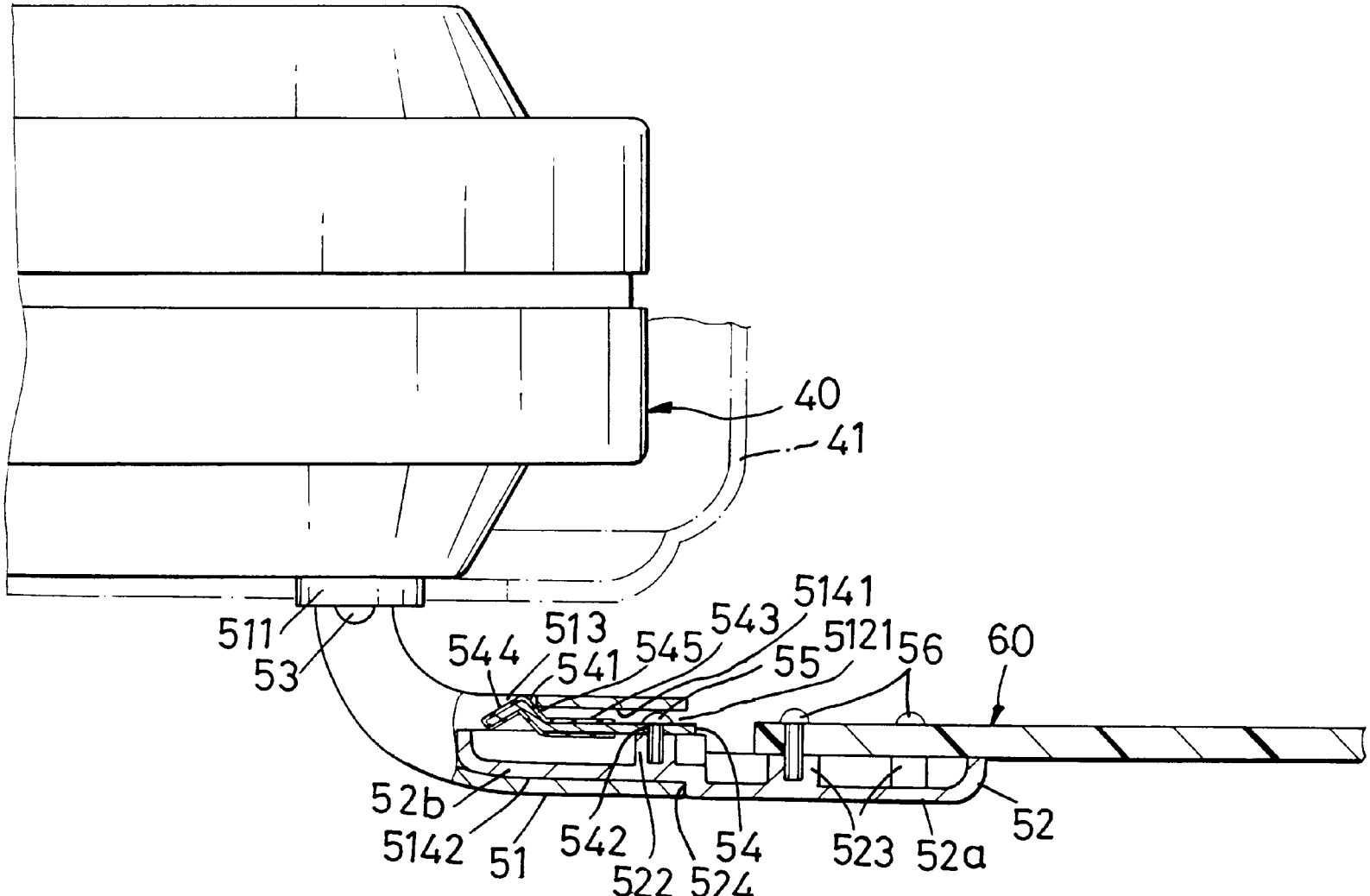

Referring to FIGS. 2 and 4, the preferred embodiment of a connecting device 50 according to the present invention is shown to be adapted to connect a fan blade 60 to a rotor of a motor 40 which is received in a casing 41. The connecting device 50 is shown to comprise a rotor mounting segment 51, a blade mounting segment 52, and a resilient retainer 54.

The rotor mounting segment 51 has a rotor connecting end 511 which is adapted to be secured threadedly on the rotor of the motor 40 by screw fasteners 53 so as to be rotated along with the rotor about an axial direction, and a socket end which extends from the rotor connecting end 511 in a radial direction relative to the rotor. The socket end includes upper and lower inner walls 5141,5142 which extend in the radial direction, and two first inner sidewalls 515 which interconnect the upper and lower inner walls 5141,5142 to confine an insert slot 512. The first inner sidewalls 515 define a first inner distance therebetween. An insert wall 516 is disposed distal to the rotor connecting end 511 and transverse to the radial direction. An insert opening 5121 passes through the insert wall 516 and is communicated with the insert slot 512.

An upper outer wall 517 is disposed at an opposite side of the upper inner wall 5141, and is formed with a recess 513 proximate to the rotor connecting end 511. The recess 513 is communicated with the insert slot 512 to form a retaining wall 5131 which extends transverse to the radial direction and which defines with the insert wall 516 a length in the radial direction along the upper inner wall 5141.

Two first outer sidewalls 514 are disposed at opposite sides of the first inner sidewalls 515 and define a first outer distance therebetween.

The blade mounting segment 52 has a blade connecting end 52*a* which is adapted for engaging the fan blade 60 by means of screw fasteners 56 that engage threadedly locking posts 523 disposed on the blade connecting end 52*a,* and a plug end 52*b* which extends from the blade connecting end 52*a* in the radial direction. The plug end 52*b* has a bottom wall 521 with such a dimension as to be fitted into the insert slot 512 from the insert opening 5121. Two opposite second outer sidewalls 526 extend upwardly from two sides of the bottom wall 521 and define a second distance therebetween that is slightly smaller than or equal to the first inner distance such that the plug end 52*b* can be inserted into the insert slot 512 of the socket end.

In addition, the blade connecting end 52*a* has two opposite third outer sidewalls 527 which are connected respectively to the second outer sidewalls 526 and which define a third distance therebetween that is greater than the second distance of the second outer sidewalls 526 so as to form a retaining shoulder 525 at a junction between the second and third outer sidewalls 526,527. Further, the third distance is substantially equal to the first outer distance of the first outer sidewalls 514.

Moreover, with reference to FIG. 4, an abutting wall 524 is disposed at the junction between the blade connecting end 52*a* and the plug end 52*b*, and extends downwardly and axially from the bottom wall 521.

The resilient retainer 54 is a spring plate with a proximate end and a distal end which has an engaging spring protrusion 541. The proximate end has two locking holes 542 for passage of two screw fasteners 55 to be inserted into two locking posts 522 mounted on the bottom wall 521 adjacent to the blade connecting end 52*a* to secure the resilient retainer 54 on the blade mounting segment 52. The engaging spring protrusion 541 of the distal end has a ridge 5411 which is formed by punching the distal end upwardly, a guiding slanting portion 544 at one side of the ridge 5411 for guiding insertion of the plug end 52*b* into the insert slot 512, and a retaining slanting portion 545 at the other side of the ridge 5411. Thus, the engaging spring protrusion 541 can provide a biasing force in the axial direction away from the bottom wall 521. As such, when the plug end 52*b* is inserted into the insert slot 512, the engaging spring protrusion 541 is brought to insert into the insert slot 512 and to be kept in sliding contact with the upper inner wall 543 against the biasing force thereof until the distal end has advanced beyond the length where the retaining slanting portion 545 abuts against and is retained at the retaining wall 5131 of the socket end. An elastomeric member 543, such as one made from a rubber material, is sleeved on the distal end of the spring plate to increase a friction force between the plug end 52*b* and the socket end, thereby preventing vibration and removal of the plug end 52*b* from the insert slot 512 when the ceiling fan operates.

Figure 3:
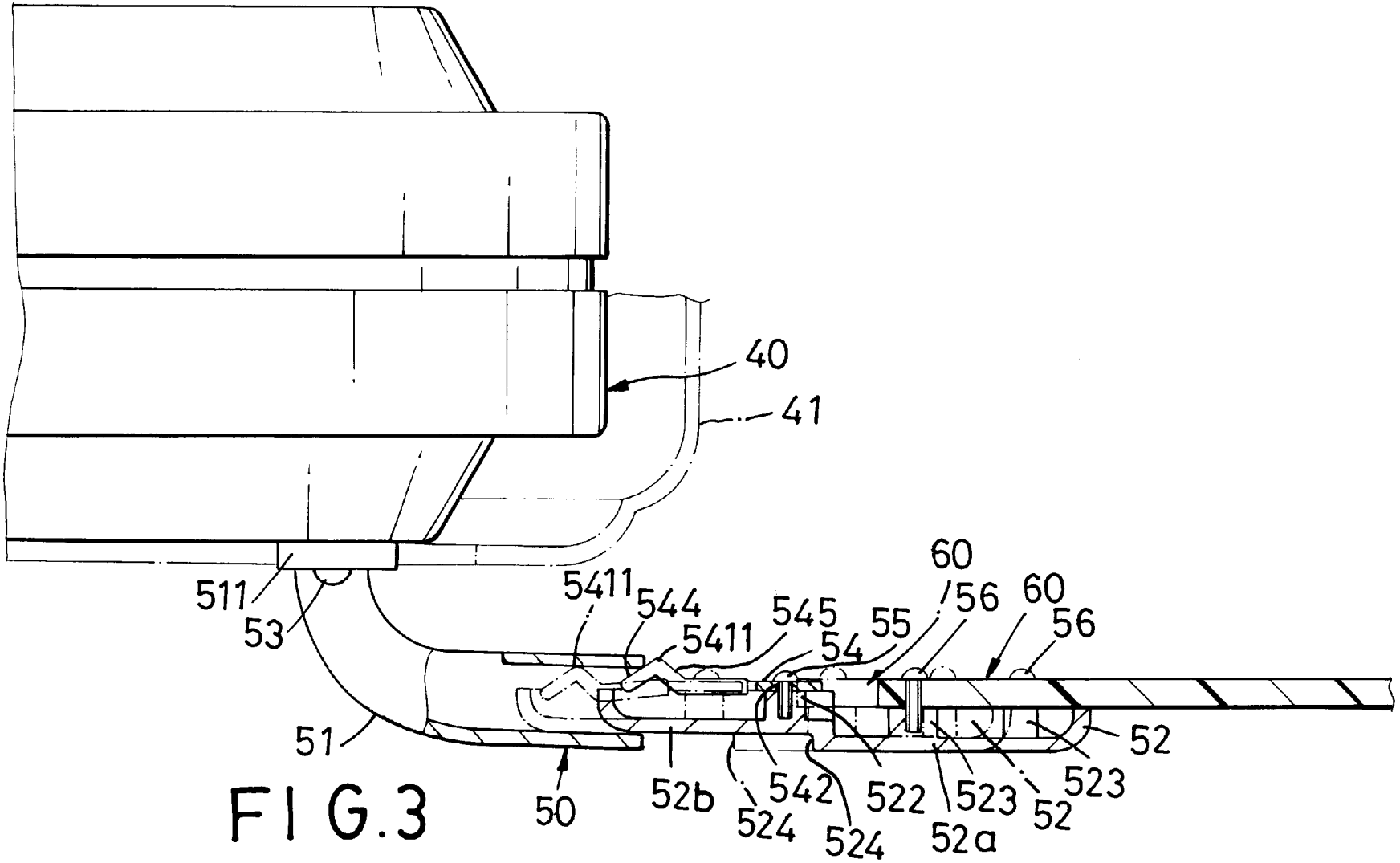
FIGS. 3 and 4 are sectional views showing how the connecting device of the preferred embodiment connects a fan blade to a motor of a ceiling fan.

Referring to FIGS. 3 and 4, the rotor connecting end 511 of the rotor mounting segment 51 and the blade connecting end 52*a* of the blade mounting segment 52 can be secured on the rotor of the motor 40 and the fan blade 60 by operators in a manufacturing plant, respectively. When it is desired to assemble the fan blade 60 to the rotor, the plug end 52*b* is inserted into the insert slot 512 from the insert opening 5121 in the radial direction against the biasing force of the engaging spring protrusion 541 until the retaining slanting portion 545 abuts against and is retained at the retaining wall 5131 of the socket end. At the same time, the retaining shoulder 525 abuts against two opposite side of the insert wall 516, and the abutting wall 524 abuts against a bottom side of the insert wall 516. By virtue of the engaging spring protrusion 541, the retaining shoulder 525, and the abutting wall 524, the plug end 52*b* can be retained firmly in the insert slot 512 of the socket end. In addition, the third outer sidewalls 527 can be aligned with the first outer sidewalls 514, respectively.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. A connecting device for connecting a fan blade and a rotor of a motor of a ceiling fan, the rotor being rotated about an axial direction, said connecting device comprising:

a rotor mounting segment having a rotor connecting end adapted to be secured on and be rotated along with the rotor about the axial direction, and a socket end extending from said rotor connecting end in a radial direction relative to the rotor, said socket end having:

an insert wall which is disposed distal to said rotor connecting end and transverse to said radial direction and which has an insert opening passing therethrough;

an insert slot which extends in said radial direction from said insert opening toward said rotor connecting end;

upper and lower inner walls which confine said insert slot in said radial direction; and an upper outer wall which is disposed at an opposite side of said upper inner wall, and which is formed with a recess proximate to said rotor connecting end, said recess extending in the axial direction to be communicated with said insert slot to form a retaining wall that extends transverse to said radial direction and that defines with said insert wall a length in said radial direction along said upper inner wall;

a blade mounting segment having a blade connecting end adapted for engaging the fan blade, and a plug end extending from said blade connecting end in the radial direction, said plug end having a bottom wall with such a dimension as to be fitted into said insert slot from said insert opening toward said rotor connecting end in said radial direction; and a resilient retainer having a proximate end secured on said bottom wall and proximate to said blade connecting end, and a distal end with an engaging spring protrusion with a biasing force in the axial direction away from said bottom wall, said distal end having such a dimension as to be brought to insert into said insert slot from said insert opening and to be kept in sliding contact with said upper inner wall against said biasing force of said protrusion until said distal end has advanced beyond said length where said engaging spring protrusion abuts against and is retained at said retaining wall of said socket end.

2. The connecting device as claimed in claim 1, wherein said resilient retainer is a spring plate with said proximate end and said distal end, said engaging spring protrusion of said distal end having a ridge which is formed by punching said distal end upwardly, a guiding slanting portion at one side of said ridge distal to said proximate end for guiding insertion of said plug end into said insert slot, and a retaining slanting portion at an opposite side of said ridge proximate to said proximate end for abutting against said retaining wall.

3. The connecting device as claimed in claim 2, further comprising an elastomeric member disposed between said distal end of said spring plate and said upper inner wall to increase a friction force between said plug end and said socket end.

4. The connecting device as claimed in claim 1, wherein said socket end of said rotor mounting segment further has two opposite first inner sidewalls interconnecting said upper and lower inner walls to confine with said upper and lower inner walls said insert slot and defining a first inner distance therebetween, and two first outer sidewalls disposed at opposite sides of said first inner sidewalls to define a first outer distance therebetween, said plug end of said blade mounting segment further having two opposite second outer sidewalls extending upwardly from two sides of said bottom wall and defining a second distance therebetween that is slightly smaller than or equal to said first inner distance, said blade connecting end of said blade mounting segment having two opposite third outer sidewalls connected respectively to said second outer sidewalls and defining a third distance therebetween that is greater than said second distance so as to form a retaining shoulder at a junction between said plug end and said blade connecting end to abut against said insert wall when said engaging spring protrusion abuts against said retaining wall.

5. The connecting device as claimed in claim 4, wherein said third distance between said third outer sidewalls of said blade connecting end is equal to said first outer distance between said first outer sidewalls of said plug end such that said third outer sidewalls can be aligned with said first outer sidewalls respectively when said socket end is inserted into said insert slot.

6. The connecting device as claimed in claim 1, wherein said plug end further has an abutting wall disposed at a junction between said plug end and said blade connecting end and extending downwardly and axially from said bottom wall so as to abut against said insert wall under said lower inner wall of said socket end when said engaging spring protrusion abuts against said retaining wall.

* * * * *